US007878032B1

(12) United States Patent
Gogel

(10) Patent No.: US 7,878,032 B1
(45) Date of Patent: Feb. 1, 2011

(54) VERSATILE GUARD FOR LOCKS SECURING ROLL-UP DOORS

(76) Inventor: Roy E. Gogel, Suite C-1, 319 Garlington Rd., Greenville, SC (US) 29615

( * ) Notice: Subject to any disclaimer, the term of this patent is extended or adjusted under 35 U.S.C. 154(b) by 327 days.

(21) Appl. No.: 11/857,071

(22) Filed: Sep. 18, 2007

Related U.S. Application Data

(60) Provisional application No. 60/855,977, filed on Nov. 1, 2006.

(51) Int. Cl.
*E05B 67/38* (2006.01)

(52) U.S. Cl. ..... 70/56; 70/54; 70/158; 292/205; 292/DIG. 32

(58) Field of Classification Search ..... 70/54, 70/55, 56, 158, 159, 160, 161; 292/104, 292/205, DIG. 29, DIG. 32
See application file for complete search history.

(56) References Cited

U.S. PATENT DOCUMENTS

| | | | | | |
|---|---|---|---|---|---|
| 4,852,920 | A * | 8/1989 | DeForrest, Sr. | ..... | 70/56 |
| 4,895,007 | A | 1/1990 | Eberly | ..... | 70/54 |
| 4,898,008 | A * | 2/1990 | Eberly | ..... | 70/56 |
| 5,735,146 | A * | 4/1998 | Taplin | ..... | 70/56 |
| 5,737,946 | A | 4/1998 | Sole et al. | ..... | 70/54 |
| 5,743,118 | A * | 4/1998 | Anderson | ..... | 70/56 |
| 6,009,731 | A * | 1/2000 | Emmons et al. | ..... | 70/56 |
| 6,463,769 | B1 * | 10/2002 | Garner | ..... | 70/56 |
| 6,581,419 | B1 * | 6/2003 | Strodtman | ..... | 70/56 |
| 6,622,533 | B1 * | 9/2003 | Santini | ..... | 70/56 |
| 7,162,898 | B2 * | 1/2007 | Gogel | ..... | 70/56 |
| 7,201,027 | B2 * | 4/2007 | Gogel | ..... | 70/56 |
| 7,412,856 | B1 * | 8/2008 | Gogel | ..... | 70/56 |
| 2008/0029529 | A1 * | 2/2008 | Ruhl | ..... | 70/56 |

* cited by examiner

*Primary Examiner*—Suzanne D Barrett
*Assistant Examiner*—Christopher Boswell
(74) *Attorney, Agent, or Firm*—Daniel C. Leonardi; John B. Hardaway, III; Nexsen Pruet, LLC

(57) ABSTRACT

A lock guard is provided for padlocks securing different type J-hook latches of roll up doors in their locking position. The lock guard shrouds the shackle of the padlock thereby deterring vandals use of cutting tools to sever the shackle.

4 Claims, 6 Drawing Sheets

VERSATILE GUARD FOR LOCKS SECURING ROLL-UP DOORS

RELATED APPLICATIONS

The priority rights are claimed concerning the inventor's United States provisional patent application for Roll-Up Door Lock Guard, Ser. No. 60/855,977 filed Nov. 1, 2006.

BACKGROUND OF THE INVENTION

Many semi-trailers used for merchandise transport have a rear roll-up door. Such doors customarily have rollers and hinged horizontal panels that fold as the door is opened by being slid customarily in an upward direction with the rollers in glides that typically curve inward at the top of the trailer at an angle approximately ninety degrees. Various locking devices have been proposed to secure roll-up doors against thieves who use bolt cutters, power hack saws, and sledge hammers to destruct the latch and/or the padlock securing the latch. The doors are traditionally secured by a J-hook pivotally mounted on the door near its bottom end. Rotation of the J-hook in a clockwise direction engages the claw of the J-hook with a fixed structural component in a rear transverse bumper, a portion of which extends rearward of the door. The operating lever of the J-hook is usually further secured by a padlock with its shackle extending through openings in the operating lever and a pivoted a lever latch a stop block fixed to the door. One J-hook manufacturer provides a lever stop having an opening through which the shackle also extends when the lock secures the J-hook lever. There are basically two styles of J-hooks for securing roll-up doors in the industry, which are named after the principal manufacturers. Most other manufacturers use a design of one of the primary two. Prior art regarding lock guards is replete with a myriad of diverse and specialized lock guards. Particularly relating to roll-up doors are Eberly U.S. Pat. No. 4,895,077 and Sole et al. U.S. Pat. No. 5,737,946. Whereas both Eberly and Sole teach the use of lock guards to protect padlocks securing the locking mechanism on roll-up doors, both applications are designed to function on only one of the two primary locking handle manufacturers and their designs will not allow universal applicability. While all of the aforementioned prior art constructions are more than adequate for the basic purpose and function for which they have been specifically designed, none of these patented devises have been specifically designed to transcend the nuances of difference between the two primary manufacturers such that one common lock guard can transcend the difference.

BRIEF DESCRIPTION OF THE INVENTION

The two most commonly used J-hook roll-up door securing devices have latching levers pivotally secured to the lower part of the door on an axis perpendicular to the door. The hook and the latching lever are rigidly secured to one another and the free end of the latching lever has a downwardly extending distal flange with an opening or bore whose axis extends parallel to the rear side of the roll-up door. There are variations in the structure of the components in the currently used J-hook devices used for latching and locking roll up doors and the herein disclosed lock guard accommodates those variations. It also became apparent in development of the invention that the lock guard should provide protection for long shackle padlocks as well as regular padlocks. One longitudinal end of the lock guard is provided with an upwardly open trough or guide chute which not only restricts access to an installed padlock but also helps to position the shackle when installing the padlock in its locking position. The opposite end of the lock guard is provided with a shelter which permits the padlock case to be turned, after the free end of the shackle has been inserted into the locking tabs, to a position aligning the free end of the shackle with its mating opening in the case. The lock guard is stabilized by the non-pivoting or free end of the shackle of the padlock passing through two aligned openings in parallel vertical interior wall members of the guard. The free end of the shackle also passes through an aligned opening in the J-hook operating lever and the operating latch. One of the two most commonly used J-hook securing devices has an opening in its stop block through which the shackle also passes, but the other or second of the most commonly used J-hook securing devices does not have such an opening in its stop block. The lateral position of the stop block of the second J-hook securing device is off set in relation to the lateral position of the stop block of the other J-hook securing device. A notch is formed in the rear wall of the lock guard to accommodate the stop block of the second J-hook securing device. The herein disclosed lock guard is advantageously used in protecting padlocks securing either of the commonly used J-hook securing devices.

BRIEF DESCRIPTION OF THE DRAWINGS

One embodiment of the invention is illustrated in the drawings, in which.

DETAILED DESCRIPTION OF THE INVENTION

Figure 1:
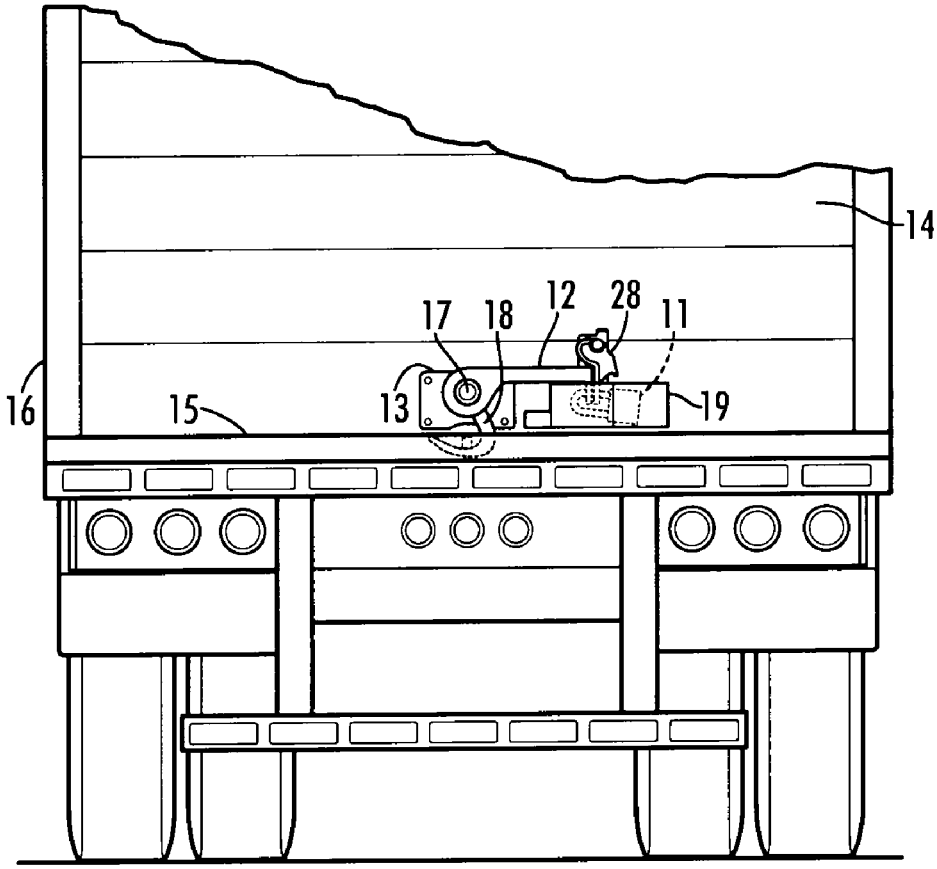
FIG. 1 is a partial rear view of a semi-trailer showing the lock guard protecting a padlock securing the J-hook in its locking position.
Figure 2A:
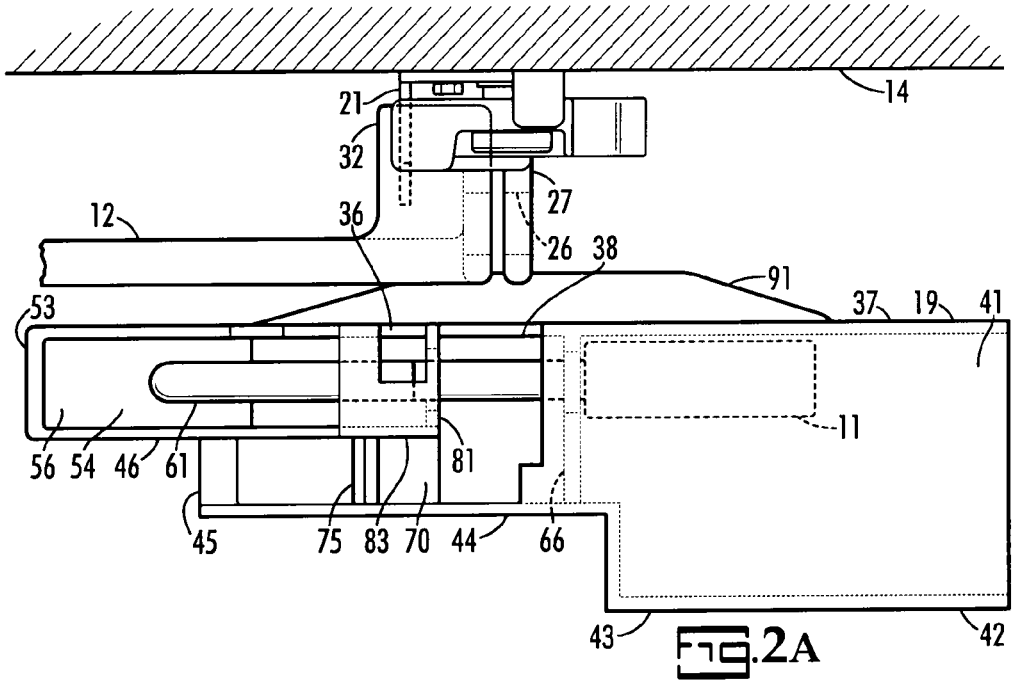
FIG. 2*a* is a top view of the lock guard and padlock positioned for connection with one style of J-hook operating handle and latch.
Figure 2B:
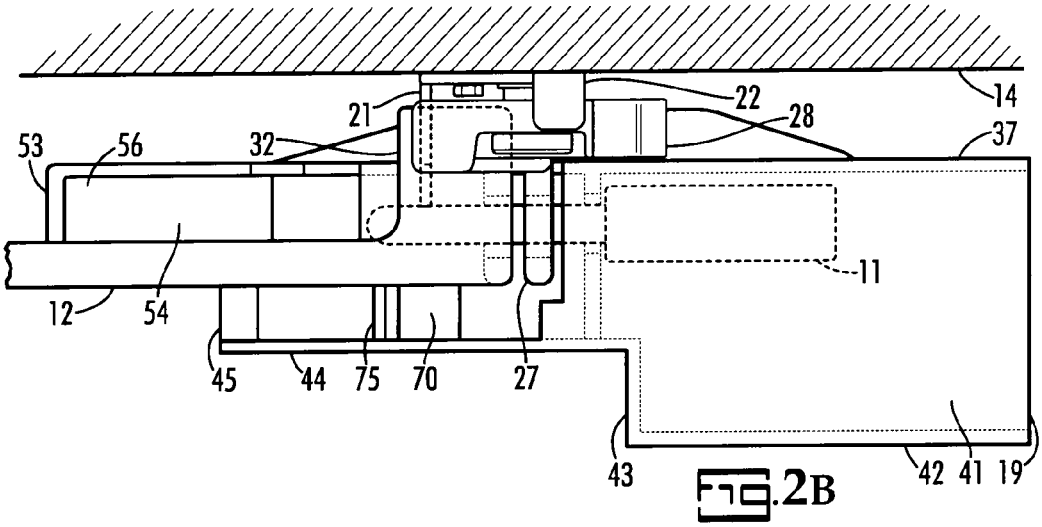
FIG. 2B is a top view of the lock guard and padlock of FIG. 2A secured to the J-hook and its latch.
Figure 3:
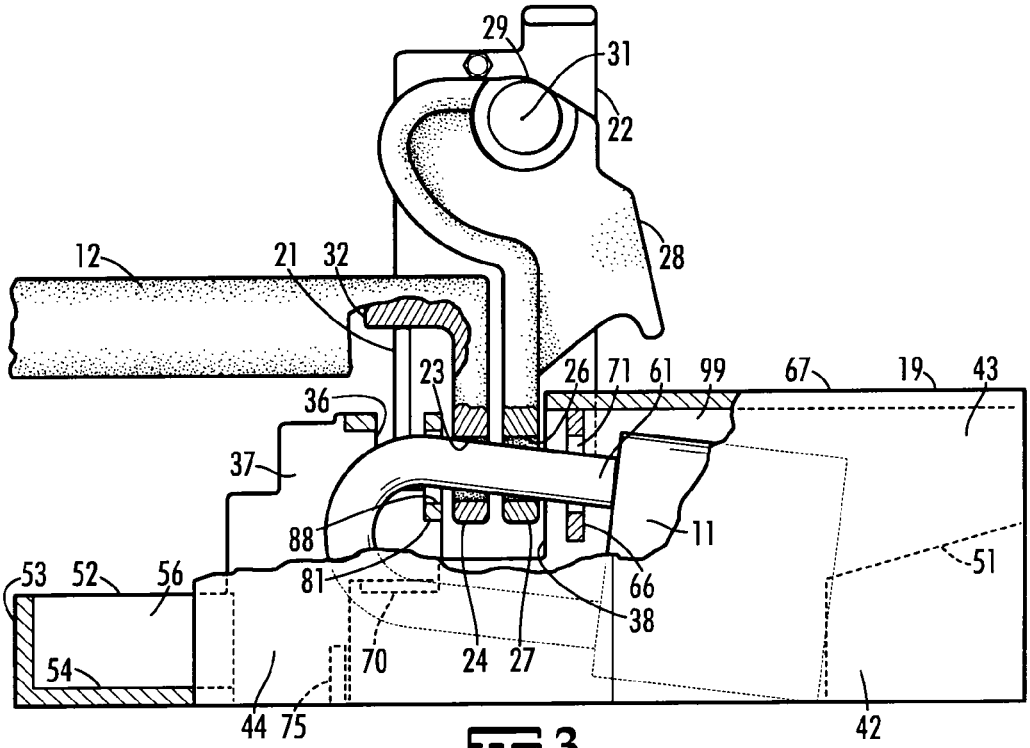
FIG. 3 is a side view of the J-hook components, padlock and lock guard shown in FIG. 2A with parts broken away for illustration purposes.
Figure 6:
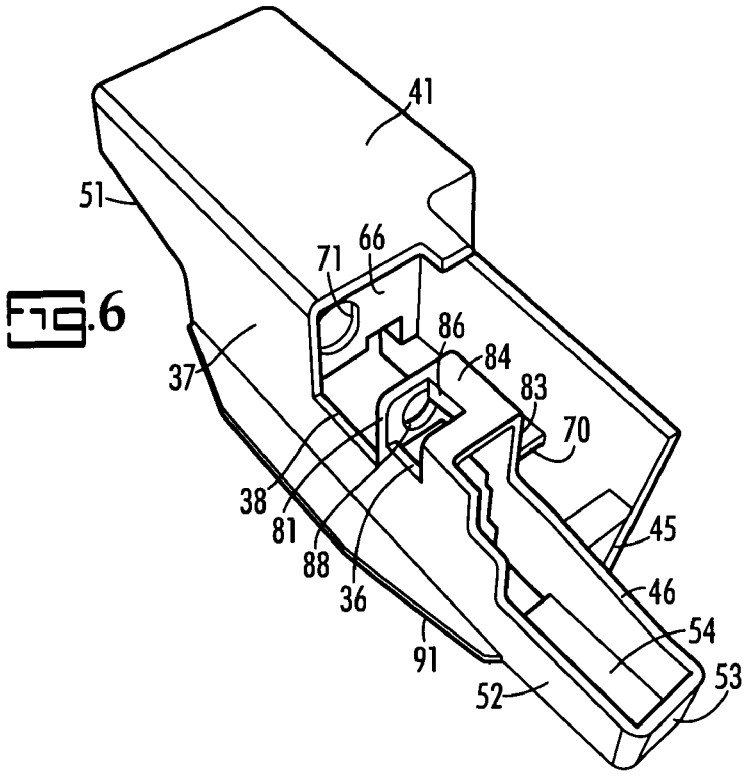
FIG. 6 is a rearward perspective of the lock guard.
Figure 7A:
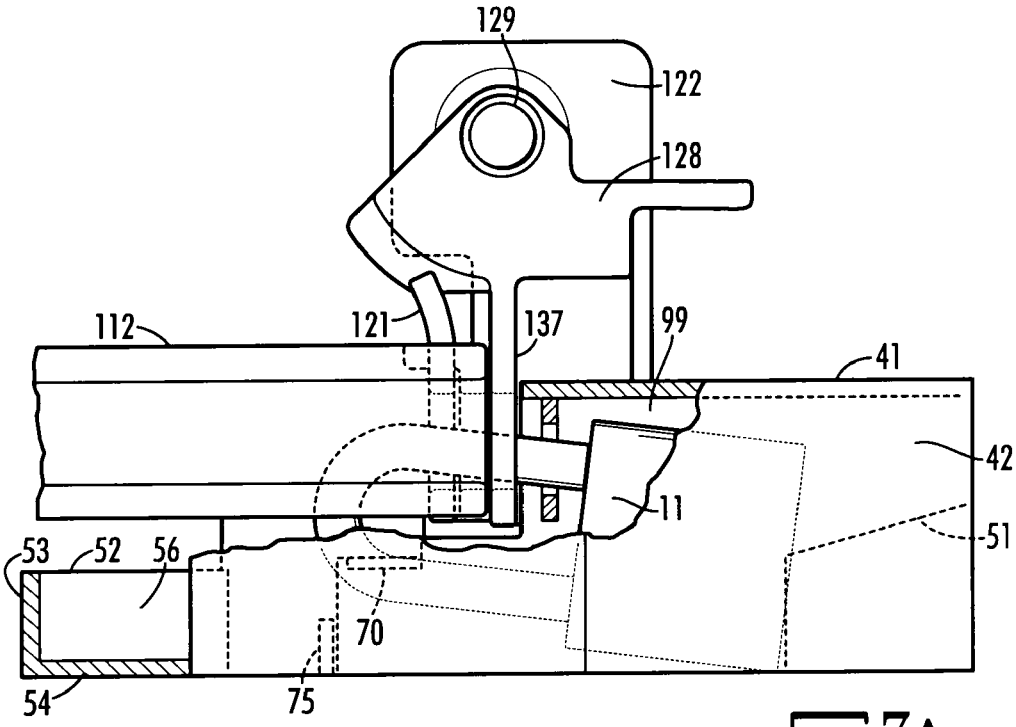
FIG. 7A is a side view, with parts broken away, showing the lock guard used with a second style J-hook.
Figure 7B:
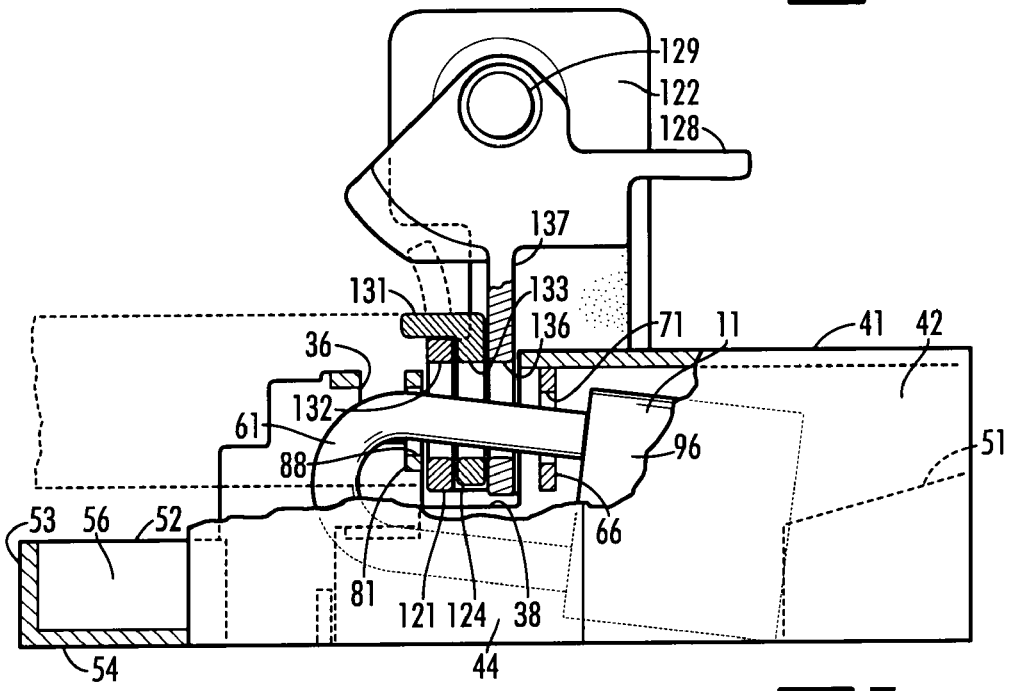
FIG. 7B is a side view similar to FIG. 7A with additional parts broken away for illustration purposes.
Figure 8:
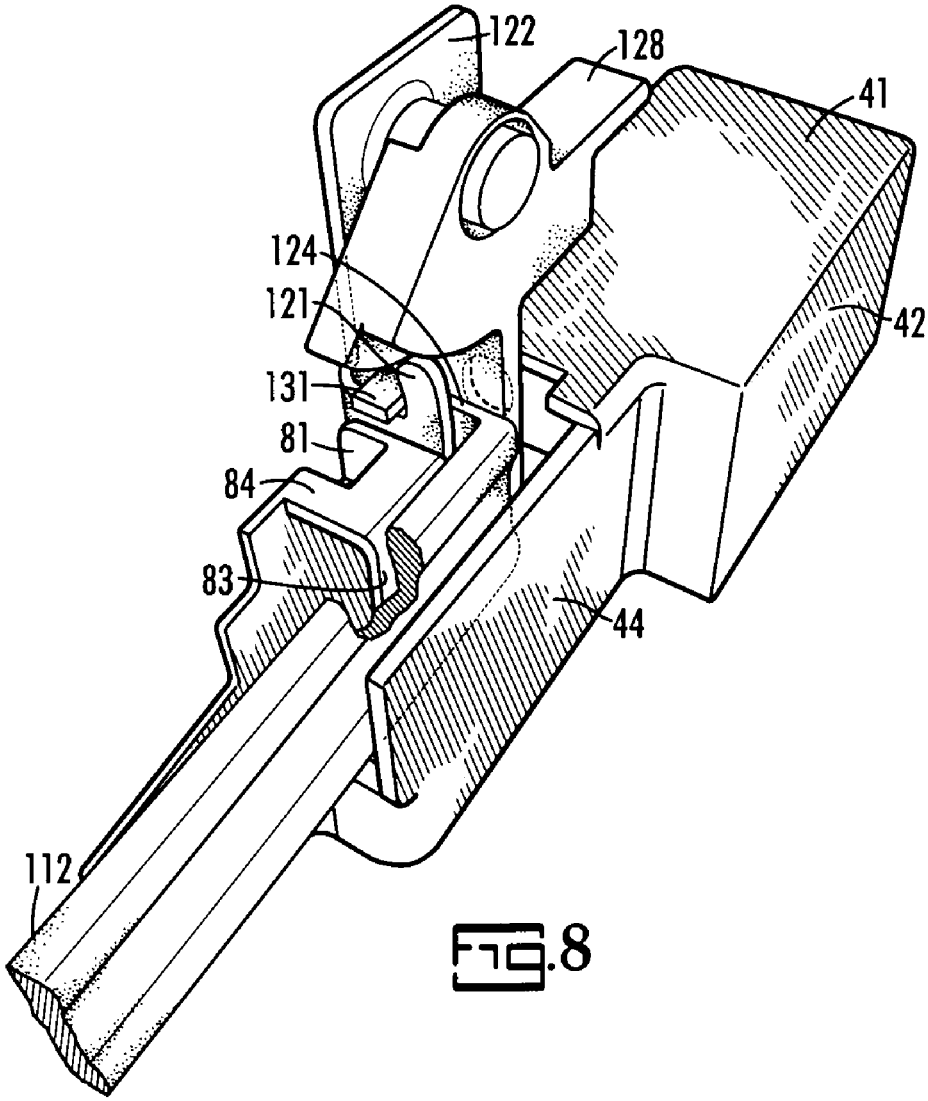
FIG. 8 is a perspective showing the lock guard used with the second style J-hook.

The lock guard illustrated in the accompanying drawings is designed to protect the padlock 11 securing either the operating lever 12 of a J-hook securing device 13, shown in FIGS. 1, 2A, 2B and 3, or the operating lever 112 of a similar J-hook securing device shown in FIGS. 7A, 7B and 8. As shown in FIG. 1 the operating lever 12 of the J-hook securing device 13 is pivotally secured to the roll up door 14 of a semi-trailer 16 on a horizontal pivot axis 17 extending longitudinally in relation to the trailer 16 and at a right angle in relation to the roll up door 14. A J-hook 18 is rigidly secured to the lever 12 and in its illustrated locking position hooks through holes precut in the top of the bumper 15 at the rear end of the floor of the trailer 16. The long shackle padlock 11 is protected by a lock guard 19. Referring also to FIG. 3, a lever stop 21 integrally formed on a mounting plate 22 rigidly secured to the roll up door 14, limits clockwise downward pivotal movement of the lever 12 so that the laterally extending horizontal opening 23 in the downwardly extending locking flange 24 of the lever 12 aligns with horizontal opening 26 in the downward extending flange 27 of the locking latch 28 pivotally connected to the mounting plate 22 by a pivot pin 29 for pivotal movement about a horizontal pivot axis 31 perpendicular to the roll-up door 14. The upper end of the stop 21 abuts a horizontally extending ledge 32 formed on the distal end of the lever 12. Referring also to FIGS. 2A, 3, 5 and 6, a notch 36 is provided in a rear wall 37 of the lock guard 19 into which the stop 21 extends when the padlock 11 and lock guard 19 are installed as shown in FIGS. 2B and 3. The vertical rear wall 37, extending parallel to the roll up door 14, also includes a notch 38 extending downward from its upper end a sufficient distance to permit entry of the locking flange 24 of the lever 12 and the locking flange 27 of the locking latch 28. The rear wall 37 extends the full longitudinal length of the lock guard 19 and when installed is in substantially parallel relation to the roll-up door 14. A top wall or roof 41 at a first longitudinal end of the lock guard extends horizontally between, and is rigidly secured to, the rear wall 37 and a segment 42 of a vertical front wall 43. Segment 42 and an in intermediate segment 44 of the front wall 43 are substantially the same height; however, a third segment 46 of the front wall 43 is of a reduced height from a horizontal bottom of the front wall 42. The rear wall 37 has a reduced height segment 52 at a second longitudinal end of the lock guard. An end wall 53 and a partial bottom wall 54 together with wall segments 46, 52, form a trough 56 adjacent and parallel to the rear wall 37 for guiding the shackle 61 during installation of the padlock 11. A short transverse wall 45 extending upwardly from the bottom of lock guard about one third its height, rigidly interconnects wall segments 44 and 46. An increased height portion of the wall segment 46 forms an intermediate wall 83 parallel to the rear wall 37. The rear wall 37, the intermediate wall 83 and the trough 56 form a guide channel for guiding the shackle 61 during its installation. The guide channel is open at its bottom except for the short bottom wall 54.

Figure 5:
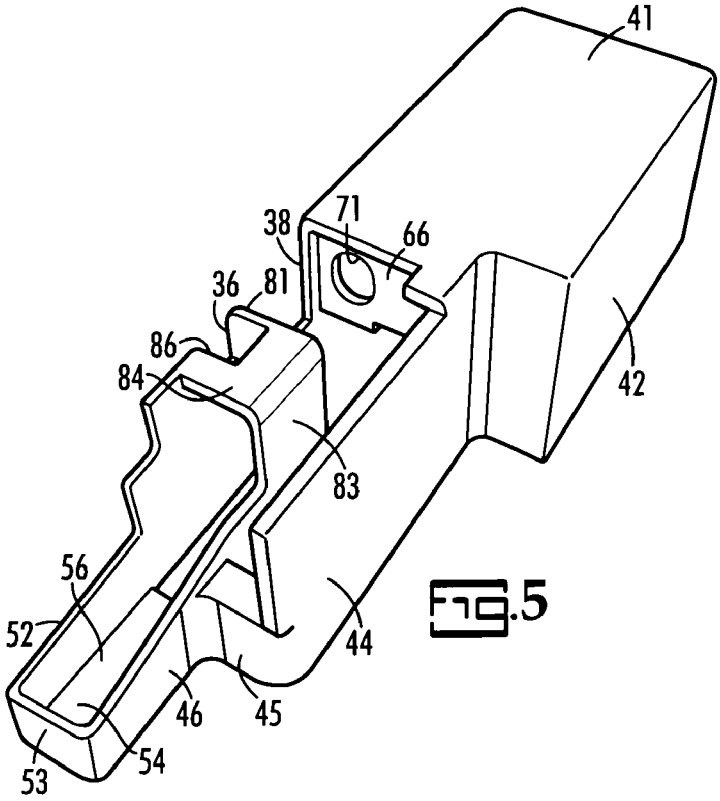
FIG. 5 is an overhead perspective view of the lock guard.

Referring also to FIGS. 5 and 6, a first vertical transverse wall or wall member 66 adjacent the first end side of the notch 38 extends downwardly from the horizontal roof 67 slightly less than one half the height of the rear wall 37 to which it is rigidly secured by welding. The first transverse wall or wall member 66 is also welded to the rear wall 37 and to the front wall intermediate segment 44 and has a horizontal annular opening 71 for the lock shackle 61. A second transverse vertical interior wall 81 is welded to and extends at a right angle from the rear wall 37 to the intermediate wall 83 to which it is also rigidly secured. A horizontal top wall 84 rigidly interconnects the intermediate wall 83, the second transverse interior wall 81 and the rear wall 37. The top wall 84 has a cut out or notch 86 extending inwardly from the rear wall 37 for accommodating the lever stop 21 on the locking plate 22. The second transverse vertical interior wall 81 includes an annular horizontal opening 88 which is horizontally aligned with the opening 71 in the transverse vertical wall 66. The transverse vertical walls 66, 81 are spaced from the bottom of the lock guard at least one half the height of the lock guard, thus providing adequate space for insertion of the shackle into the guide channel 56. An intermediate horizontal wall 70 and a transverse vertical wall 75 between wall 83 and front wall segment 44 add reinforcement to the lock guard. As shown in FIG. 2A, the open shackle 61 of the padlock 11 is inserted into the trough 56 in preparation for insertion of the unhinged leg of the shackle 61 into the aligned openings 88, 23, 26, 71 in the transverse wall 81, the lever flange 24, the locking latch flange 27 and the transverse wall 66.

Figure 4:
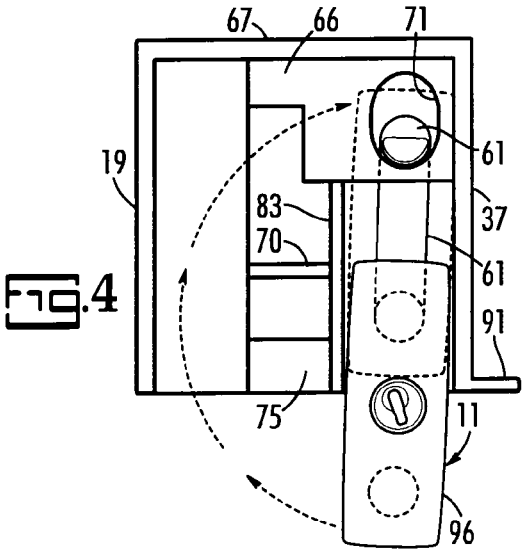
FIG. 4 is an end view of the lock guard and padlock shown in FIG. 2A.

FIGS. 2A and 4 show the open shackle 61 being positioned for insertion through the aligned openings 71, 88 in the transverse walls 66, 81. After insertion of the unhinged leg of the shackle through the openings 88, 23, 26, 71 a finger may be inserted though an opening defined by the rear wall 37, wall segment 83, bottom wall 54 and interior wall 81 to engage and force closure of the shackle 61. A horizontal reinforcing ledge 91 extending horizontally rearward a short distance from the lower end of the back wall 37 also helps to orient the lock guard and padlock during installation. Upon closure of the installed padlock 11, the case 96 of the padlock is disposed within the cavity 99 formed by the rear wall 37, the front wall segment 42, top wall 41 and transverse interior wall member 66. As shown in FIG. 4, the before mentioned protective cavity 99 is open at its bottom and is at least as wide as the width of the case 96 of the padlock 11, so as to permit the case 96 to be rotated about its hinged leg to a locking position, as illustrated in FIG. 3. The protective cavity or shelter 99 is longer, in the elongated direction of the lock guard, than the length of the padlock case 96. In its installed condition the bottom of the lock guard is close to the semi-trailer bumper 15, thus limiting underside access to the padlock 11. As shown in FIGS. 3, 6, 7A and 7B, a quadrilateral segment of the rear wall has been removed at the first end of the lock guard leaving a trapezoidal shaped notch or opening 51 in the rear wall 37 adjacent the open end and bottom of the protective shelter or cavity 99 for the case 96 of the padlock 11. The notch 51 provides additional space for the fingers of the hand installing the padlock 11 including the steps of installing the shackle 61 in the aligned openings in the J-hook apparatus and lock guard and then closing the shackle 61.

FIGS. 7A, 7B and 8 show the lock guard used with the padlock 11 securing the pivot or securing lever 112 of a second style J-hook securing device to a locking latch 128 pivotally supported on a mounting plate 122 by a horizontal pivot pin 129, whose axis is perpendicular to the roll up door 14. A vertical locking flange 124 on the distal end of the operating lever 112 extends horizontally from the lever 112 toward the mounting plate 122 and the lever 112 is positioned in a valley between the intermediate front wall segment 44 and the intermediate wall segment 83. A horizontal lip 131 projects horizontally from the end of the lever 112 and from the locking flange 124 and engages a lever stop 121 in the locking position of the J-hook pivot lever 112, as shown in FIGS. 7A, 7B and 8. Unlike the J-hook device shown in FIGS. 2A, 3 and 4, the stop flange 121 on the mounting plate 122 includes an annular horizontal opening 132 which in the illustrated locking position of the lever 112 is horizontally aligned with an annular opening 133 in the locking flange 124 of the lever 112, an annular opening 136 in a flange 137 of the locking latch 128 and the openings 88 and 71 in the transverse walls 81 and 66, respectively. All three of the flanges 121, 124 and 137 fit within the opening or notch 38 and in the space between the top wall 41 and the abbreviated top wall 84.

The herein disclosed lock guard protects shackle padlocks securing either of the two most commonly used J hook levers employed to latch roll up doors in their closed position. The guide trough 56 helps to position the shackle and together with interior and exterior walls provides padlock shelter denying access to bolt cutter and saw devices. The first, second and third front wall segments 42, 44 and 46 positioned large, medium and small distances from the straight rear wall 37 contribute to a compact protective guard. Having thereby described the subject matter of the present invention, it should be apparent that many substitutions, modifications and variations of the invention are possible in light of the above teachings. It is therefore to be understood that the invention as taught and described herein is only to be limited to the extent of the breath and scope of the appended claims.

What is claimed is:

1. A horizontally elongated guard for a padlock having a case of predetermined length, width and thickness and a mating shackle which in its open position is adapted to pass its unhinged leg through aligned openings in a locking flange of a J-hook pivot lever pivotally connected to the lower portion of a roll-up door and a locking flange of a lever latch also pivotally connected to the roll-up door, said guard comprising:

a vertical rear wall adapted for positioning alongside said roll-up door, said rear wall extending to and defining first and second ends of said guard, a vertical front wall having first, second and third segments positioned large, medium and small lateral distances, respectively, from said rear wall, said segments being parallel to said rear wall, said first segment being laterally spaced from said rear wall at least a distance equal to the width of said case and said third segment being laterally spaced from said rear wall a distance slightly greater than the diameter of said shackle, an intermediate vertical wall formed in continuation of said third segment of said front wall and extending toward said first end of said guard forming a wall parallel to and spaced from said rear wall and said second segment of said front wall, said first segment of said front wall and said rear wall each having a height at least equal to the width of said case, said front wall having the same horizontal length as said rear wall, a top wall extending between and rigidly secured to the upper end of said first segment of said front wall and to the upper end of the part of said rear wall laterally across from said first segment of said front wall, a first vertical interior wall extending laterally between and rigidly secured to said front and rear walls, said interior wall being disposed near the junction of said first and second segments of said front wall, an annular opening in said first interior wall near its upper end, a second vertical interior wall extending laterally between and rigidly secured to said rear wall and said intermediate vertical wall, said second interior wall being parallel to and spaced from said first interior wall in a direction away from said first end of said lock guard and having a second opening aligned with said first opening, a bottom wall rigidly secured to and extending laterally between the lower end of said third segment of said front wall and the bottom portion of said rear wall laterally across from said third segment, a vertical end wall rigidly secured to and extending between said third segment of said front wall and said rear wall at said second end of said lock guard, said bottom wall, said rear wall and said third segment of said front wall forming a trough with an inwardly open end, said trough being configured to receive the shank of said padlock in it open position, and an entryway in said rear wall between said first and second interior walls extending downwardly from the top of said rear wall a sufficient distance to allow entry of said locking flanges so their openings align with said openings in said interior walls.

2. A lock guard for a padlock having a case with predetermined height, width and thickness and an unhinged leg of a shackle passing through aligned openings in a flange on a J-hook lever and a flange on a locking plate, the lever and locking plate being pivotally connected to the lower portion of a roll-up door on different axes said lock guard, comprising:

horizontally elongated vertical front and rear walls extending between first and second horizontally opposite ends of said lock guard, each including a first portion extending from said first end a distance at least as great as the height of said case and each including a second portion extending from said second end having a height between one fourth and one half the height of said first portions of said front and rear walls;

a roof rigidly secured to the top of said first portion of said front and rear walls, a floor secured to the bottom of said second portions of said front and rear walls, an end wall secured to said floor and said second end of said front and rear walls, said end wall having a height between one fourth and one half the height of said first portions of said front and rear walls, the second portions of said front and rear walls, the end wall and the floor forming a trough for receiving said shackle when installing said unhinged leg in said aligned openings, a first vertical interior wall extending between and rigidly secured to said front wall, rear wall and roof near the end of said roof remote from said first end of said lock guard and including a horizontal opening for receiving said unlatched leg of said shackle of said padlock, a second vertical interior wall spaced from said first vertical wall in the direction away from said one end of said lock guard, said second interior wall having an opening aligned with said opening in said first interior wall for receiving the unhinged leg of the shackle of said padlock, a first notch in said rear wall of said guard between said vertical interior walls permitting entry of said flanges of said lever and locking plate whereby their openings are aligned with said openings in said vertical walls, and a second notch in said rear wall of said guard at the side of said second interior wall remote from said first wall for receiving a stop fixed to said roll-up door limiting downward pivotal movement of a J-hook lever.

3. A horizontally elongated guard for a padlock having a case of predetermined length, width and thickness and a mating shackle having an unhinged leg adapted for insertion through aligned openings in locking flanges of a J-hook lever and a locking latch pivotally connected to a roll up door, said guard comprising:

vertical front and rear parallel walls, a roof and a first vertical interior wall perpendicular to said rear wall forming a shelter for said case of said padlock having an open bottom and an opening at one longitudinal end of said guard, said first interior wall having a horizontal opening adapted to receive said unhinged leg of said shackle, an intermediate vertical wall parallel to said front and rear walls extending from the other longitudinal end of said guard;

a second vertical interior wall perpendicular to and secured to said rear wall and to said intermediate wall and having a horizontal opening aligned with said opening in said first interior vertical wall, said second interior wall being spaced from said first interior wall in a horizontal direction away from said one end of said guard a sufficient distance to permit entry of said locking flanges of said lever and latch;

an opening in said rear wall between said first and second interior walls and extending downwardly a sufficient distance to permit side entry of said locking flanges of said lever and latch so that their openings align with said openings in said interior walls, said front wall and said intermediate wall forming a slot for receiving a J hook lever and a bottom wall secured to said rear and intermediate walls and extending from the second end of said guard 20 to 30% of the longitudinal length of said guard, said bottom, rear and intermediate walls forming a guide and protective trough for said shackle.

4. The lock guard of claim 3 having a top wall segment extending between and secured to said rear, intermediate and second interior walls and a notch extending from said rear wall into said top wall segment to receive a lever stop secured to said roll up door.

* * * * *